US005953912A

United States Patent [19]

Kaiho et al.

[11] Patent Number: 5,953,912

[45] Date of Patent: Sep. 21, 1999

[54] EXHAUST MANIFOLD OF A MULTI-CYLINDER INTERNAL COMBUSTION ENGINE

[75] Inventors: Hideo Kaiho; Kouichi Fujimori; Hiroshi Hashimoto; Takashi Komatsuda; Kazuo Ishii, all of Wako, Japan

[73] Assignee: Honda Giken Kobyo Kabushiki Kaisha, Tokyo, Japan

[21] Appl. No.: 08/925,066

[22] Filed: Sep. 8, 1997

[30] Foreign Application Priority Data

| | | | |
|---|---|---|---|
| Sep. 10, 1996 | [JP] | Japan | 8-239170 |
| Sep. 10, 1996 | [JP] | Japan | 8-239171 |
| Oct. 9, 1996 | [JP] | Japan | 8-268295 |
| Oct. 9, 1996 | [JP] | Japan | 8-268296 |

[51] Int. Cl.[6] ..... F01N 7/10

[52] U.S. Cl. ..... 60/323; 60/322

[58] Field of Search ..... 60/323, 322

[56] References Cited

U.S. PATENT DOCUMENTS

| | | | |
|---|---|---|---|
| 3,864,909 | 2/1975 | Kern | 60/322 |
| 4,142,366 | 3/1979 | Tanahashi et al. | 60/322 |
| 5,331,810 | 7/1994 | Ingermann et al. | 60/322 |
| 5,349,817 | 9/1994 | Bekkering | 60/323 |

FOREIGN PATENT DOCUMENTS 4-1292 1/1992 Japan .

*Primary Examiner*—F. Daniel Lopez
*Assistant Examiner*—Binh Tran
*Attorney, Agent, or Firm*—Armstrong, Westerman, Hattori, McLeland & Naughton

[57] ABSTRACT

A heat-insulating, light and vibration-proof exhaust manifold for a multi-cylinder internal combustion engine is provided. The exhaust manifold comprises an upper stream flange, a lower stream flange, four manifold pipes at an upper stream, a manifold chamber (gathering section) at a lower stream and a manifold case of a plate metal covering the manifold pipes and the manifold chamber. The manifold pipes have upper stream ends to be connected to exhaust ports of the internal combustion engine through the upper stream flange and lower stream ends gathering in the manifold chamber. Upper stream ends of the manifold pipes and the manifold case are welded to the upper stream flange, and lower stream ends of the manifold chamber and the manifold case are welded to the lower stream flange. The manifold pipe and the manifold chamber can slide relatively at a slide portion which is maintained by pressing the manifold chamber and the manifold case against the manifold pipe.

8 Claims, 16 Drawing Sheets

EXHAUST MANIFOLD OF A MULTI-CYLINDER INTERNAL COMBUSTION ENGINE

BACKGROUND OF THE INVENTION

The present invention relates to a multi-cylinder internal combustion engine for a motorcar, and particularly to an exhaust manifold thereof having a good performance to keep exhaust in high temperature.

A cast exhaust manifold has thick walls and is heavy, therefore it hinders lightening an internal combustion engine or a vehicle body to be mounted with the engine and has an inconvenience that on starting, exhaust is cooled because of large heat capacity of the manifold to lower an initial performance of an exhaust cleaning catalyst.

In order to maintain the initial performance of the exhaust cleaning catalyst, it is necessary to keep the exhaust at a temperature higher than a predetermined temperature. To cope with this, the exhaust passage may be covered with inner and outer double walls to keep temperature of the exhaust by an insulating air layer between the inner and outer walls.

Japanese Utility Model Publication No. Hei 4-1292 discloses an exhaust manifold based on the above principle.

In this exhaust manifold, upper stream ends of a plurality of cylindrical guide pipes are connected to respective holes of an exhaust port side flange, a manifold case is attached to the exhaust port side flange at an upper stream end and to an exhaust pipe connecting flange at a lower stream end, and the guide pipes are merely arranged in the manifold case with a space between.

The upper stream end of the cylindrical guide pipes is fitted into the hole of the exhaust port side flange and fixed thereto, but the lower stream end of the cylindrical guide pipe is merely arranged freely so as to move also in a direction perpendicular to a longitudinal direction of the guide pipe. As a result, the cylindrical guide pipe vibrates due to vibration of the internal combustion engine or periodic vibration of exhaust pressure in the manifold case, the cylindrical guide pipe comes into contact with the manifold case due to an external force such as gravity or acceleration force, and vibrations and noises occurring at the cylindrical guide pipe are radiated through the manifold case into the atmosphere to reduce vibration-proof and sound-proof characters of the exhaust manifold.

In addition, by contact of the cylindrical guide pipe with the manifold case, heat in the exhaust is radiated from the cylindrical guide pipe through the manifold case into the atmosphere to lower the exhaust temperature.

Since the exhaust port side flange and the exhaust pipe connecting flange are connected by the manifold case only, strength and rigidity of the exhaust manifold main body are low so that the exhaust pipe connecting flange has to be supported by the internal combustion engine or the vehicle body mounted with the engine.

SUMMARY OF THE INVENTION

The present invention relates to an improvement of an exhaust manifold of a multi-cylinder internal combustion engine overcoming such problems as described above and provides an exhaust manifold of a multi-cylinder internal combustion engine including a plurality of thin wall manifold pipes having upper stream ends connected with exhaust ports of the internal combustion engine and lower stream ends gathering in a gathering section made of a plate metal, comprising a case of a plate metal fitted around the manifold pipes and the gathering section with a space between; an upper stream flange to which upper stream ends of the manifold pipes and the case are welded; a lower stream flange to which lower stream ends of the gathering section and the case are welded; and a slide portion at which the manifold pipe and the gathering section can slide relatively along a longitudinal direction of the manifold pipe. The slide portion is maintained pressed by the gathering section and the case from exterior.

According to the present invention, exhaust flowing out from an exhaust port of the internal combustion engine passes through a manifold pipe, flows into the gathering section to join with other exhausts from other manifold pipes and is discharged into an exhaust pipe. Thus, the exhaust flows smoothly without generating a disturbance of the flow to maintain high engine output and efficiency.

The manifold pipe and the gathering section come into direct contact with the exhaust of high temperature to be heated to the high temperature, therefore, the manifold pipe and the gathering section remarkably expand and contract along direction of flow of the exhaust. However, since the manifold pipe and the gathering section is held so as to slide relatively along the longitudinal direction of the manifold pipe at the slide portion, the expansion and contraction are absorbed by relative movement of the manifold pipe and the gathering section so that thermal stresses occurring in the manifold pipe, the gathering section and the case are restrained and durability of the exhaust manifold is improved.

The manifold pipe has a thin wall and the gathering section is made of a plate metal so that heat capacity of the both is small, moreover the manifold pipes and the gathering section are covered with the case with a space between. Therefore, the exhaust manifold has high heat insulation nature and even immediately after start of the internal combustion engine, the manifold pipes and the gathering section are heated to high temperature rapidly to maintain high temperature of the exhaust, so that the exhaust cleaning catalyst is activated immediately and the exhaust can be sufficiently cleaned even immediately after the start. In addition, because of the excellent heat insulation of the exhaust manifold, radiant heat radiated from the exhaust manifold is reduced and atmospheric temperature in an engine room can be kept low.

Since the manifold pipe and the gathering section are held so as to slide along the longitudinal direction of the manifold pipe at the slide portion, and the slide portion is maintained pressed by the gathering section and the case from exterior, even if vibration of the internal combustion engine or a vehicle mounted with the engine is transmitted to the exhaust manifold, the slide portion is kept in a stable and stationary state, stress occurring in the slide portion due to the vibration is restrained, and durability of the slide portion and the manifold pipe is improved.

The slide portion may be maintained by inwardly projecting parts formed on the gathering section and the case respectively. Since the slide portion is directly held by the inwardly projecting parts, the supporting rigidity is improved by the simple construction, heat conduction from the manifold pipe and the gathering section contacted with the exhaust and heated to the case is restrained, and the exhaust is kept at its sufficiently high temperature.

Further, the slide portion may be maintained by meshes arranged between the manifold pipe and the gathering section and between the gathering section and the case. The heat insulation nature is maintained in a high level and smooth movement for the thermal expansion and contraction is possible.

According to an aspect of the present invention, there is provided an exhaust manifold of a multi-cylinder internal combustion engine including a plurality of thin wall manifold pipes having upper stream ends connected with exhaust ports of the internal combustion engine and lower stream ends gathering in a gathering section made of a plate metal, comprising a case fitted around the manifold pipes and the gathering section with a space between; an upper stream flange to which upper stream ends of the manifold pipes and the case are welded; and a lower stream flange to which a lower stream end of the case is welded. Lower stream portions of the manifold pipes are welded to upper stream portions of the gathering section, and a lower stream end of the gathering section is held so as to slide relatively to the case.

Effects of expansion and contraction of the manifold pipe and the gathering section is absorbed by the relative sliding between the lower stream end of the gathering section and the case so that thermal stresses occurring in the manifold pipe, the gathering section and the case are restrained and strength, rigidity and durability of the exhaust manifold are improved.

If at least one of the manifold pipes has an upper stream end or a lower stream portion held so as to slide, difference of thermal expansion between respective manifold pipes can be absorbed.

According to another aspect of the present invention, there is provided an exhaust manifold of a multi-cylinder internal combustion engine including a plurality of thin wall manifold pipes having upper stream ends connected with exhaust ports of the internal combustion engine and lower stream ends gathering in a gathering section made of a plate metal, comprising a case of a plate metal fitted around the manifold pipes and the gathering section with a space between, an upper stream flange to which upper stream ends of the manifold pipes and the case are welded, a lower stream flange to which lower stream ends of the gathering section and the case are welded, a connecting pipe for connecting the manifold pipe and the gathering section with each other, welded to an upper stream open end of the gathering section, and a slide portion provided on said connecting pipe by which the manifold pipe and the gathering section can slide relatively.

Since the manifold pipe and the gathering section are held so as to slide relatively along the longitudinal direction of the manifold pipe by the slide portion provided on the connecting pipe which is welded to the upper stream open end of the gathering section, influences of expansion and contraction of the manifold pipe and the gathering section are absorbed by the relative sliding between the manifold pipe and the gathering section so that thermal stresses occurring in the manifold pipe, the gathering section and the case are restrained and durability of the exhaust manifold is improved.

The lower stream portion of the manifold pipe is held so as not to move in the direction perpendicular to the longitudinal direction of the manifold pipe by the slide portion of the connecting pipe which is integral with the upper stream open end of the gathering section, therefore, even if vibration of the internal combustion engine or a vehicle mounted with the engine is transmitted to the exhaust manifold, the exhaust manifold maintains high heat insulating nature, the slide portion is held in a stable and stationary state, the manifold pipe is stably supported at the both ends, stress occurring in the slide portion due to the vibration is restrained and durabilities of the slide portion and the manifold pipe are improved.

According to a further aspect of the present invention, there is provided an exhaust manifold of a multi-cylinder internal combustion engine including a plurality of thin wall manifold pipes having upper stream ends connected with exhaust ports of the internal combustion engine and lower stream ends gathering in a gathering section made of a plate metal, wherein a case of a plate metal is fitted around the manifold pipes and the gathering section with a space between, wall thickness of the manifold pipe is thinner than wall thickness of the gathering section, and wall thickness of the gathering section is thinner than wall thickness of the case.

Since heat capacities of the manifold pipe and the gathering section which come into direct contact with the exhaust are smaller than that of the case and the case covers the manifold pipe and the gathering section with a space between, the exhaust of high temperature is not cooled so much and contacted with the exhaust cleaning catalyst at a lower stream side of the exhaust manifold so that the exhaust cleaning catalyst can be activated immediately.

A slide portion at which the manifold pipe and the gathering section can slide relatively may be provided and maintained by inwardly projecting parts formed on the gathering section and the case, so that difference of thermal expansion between the manifold pipe—gathering case and the case can be absorbed, further the lower stream end of the manifold pipe which is liable to vibrate due to vibration of the internal combustion engine or the vehicle can be supported stably.

DETAILED DESCRIPTION OF THE PREFERRED EMBODIMENT

Figure 1:
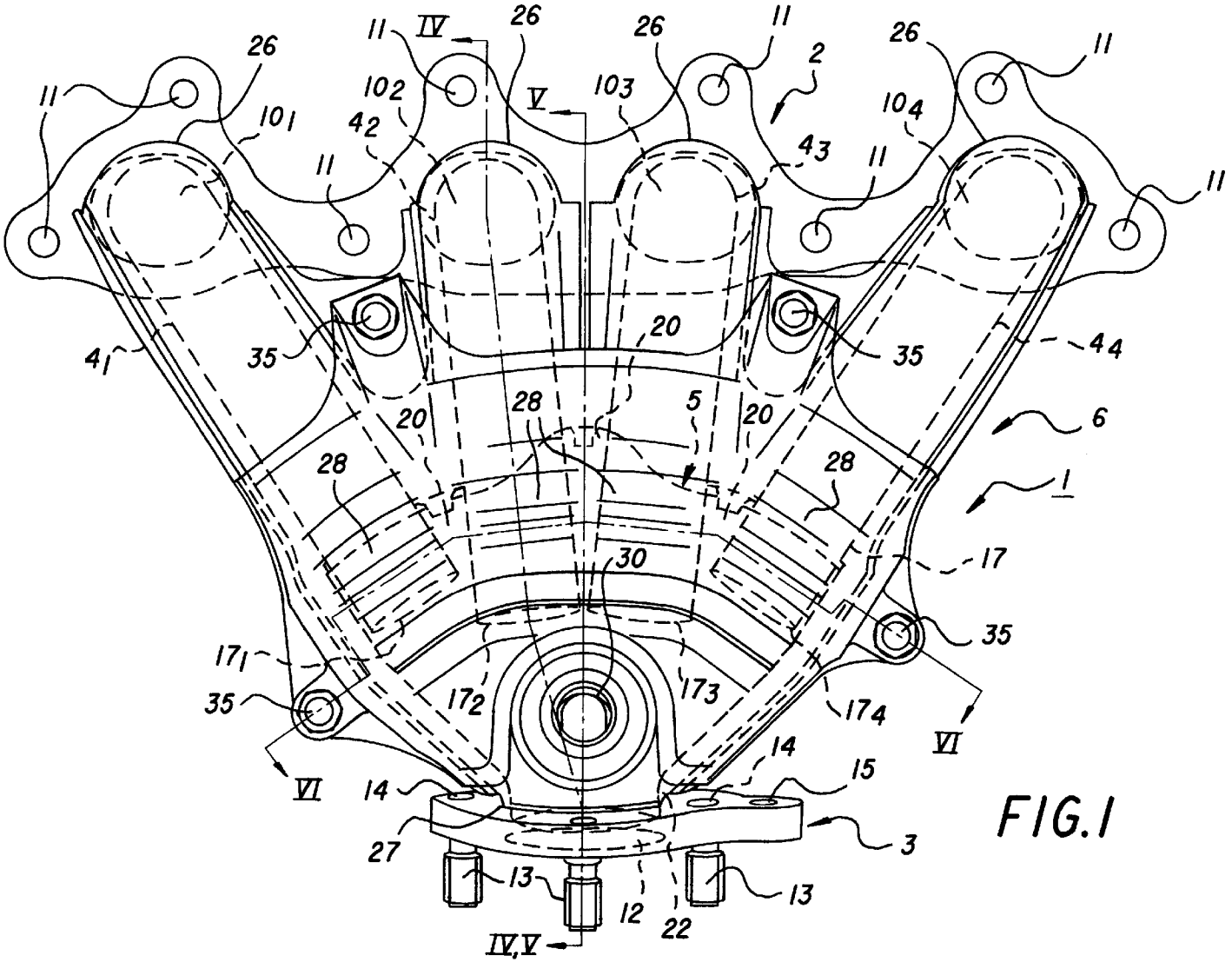
FIG. 1 is a front view showing an embodiment of an exhaust manifold of a multi-cylinder internal combustion engine according to the present invention.
Figure 2:
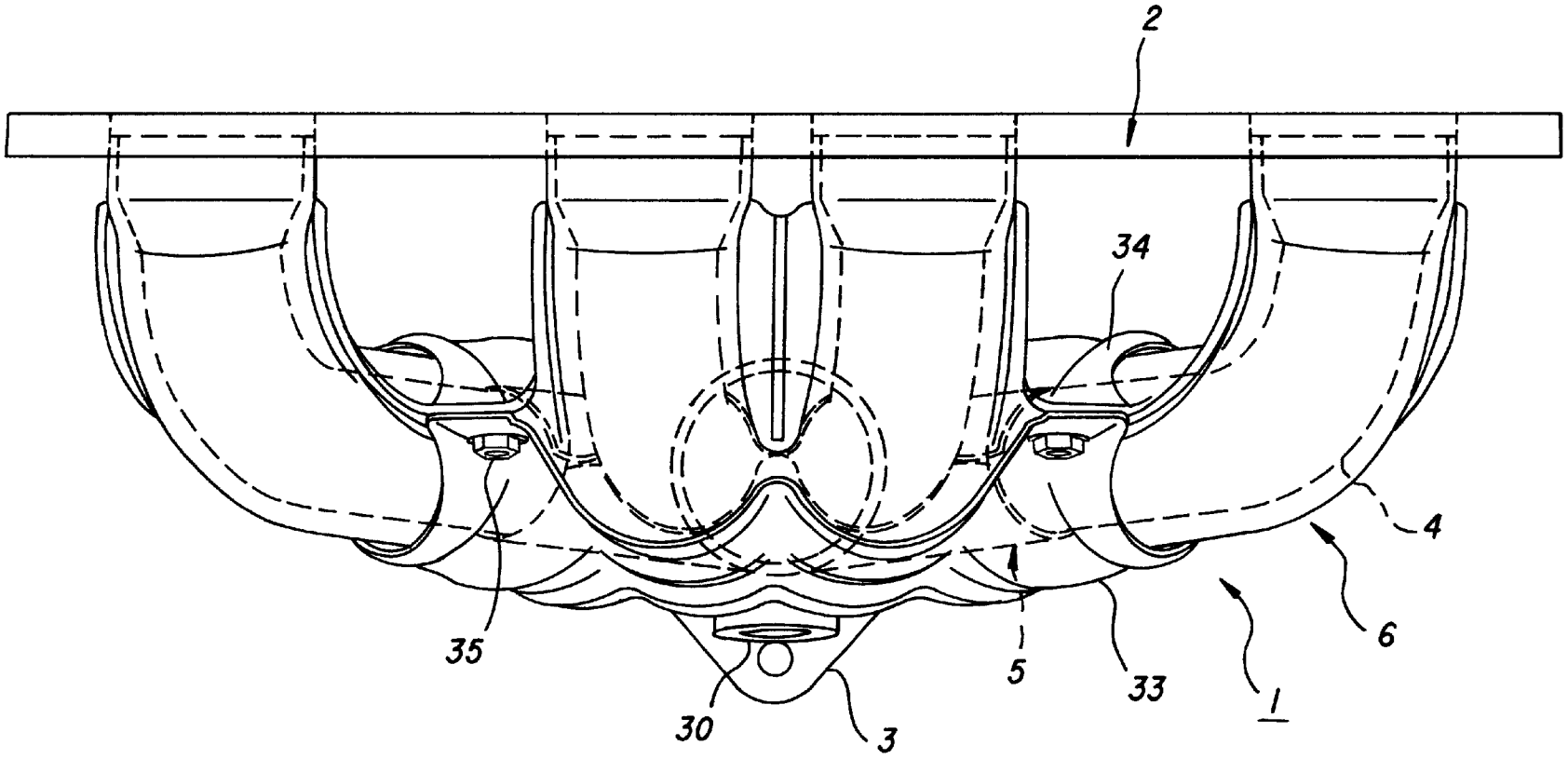
FIG. 2 is a plan view thereof.
Figure 3:
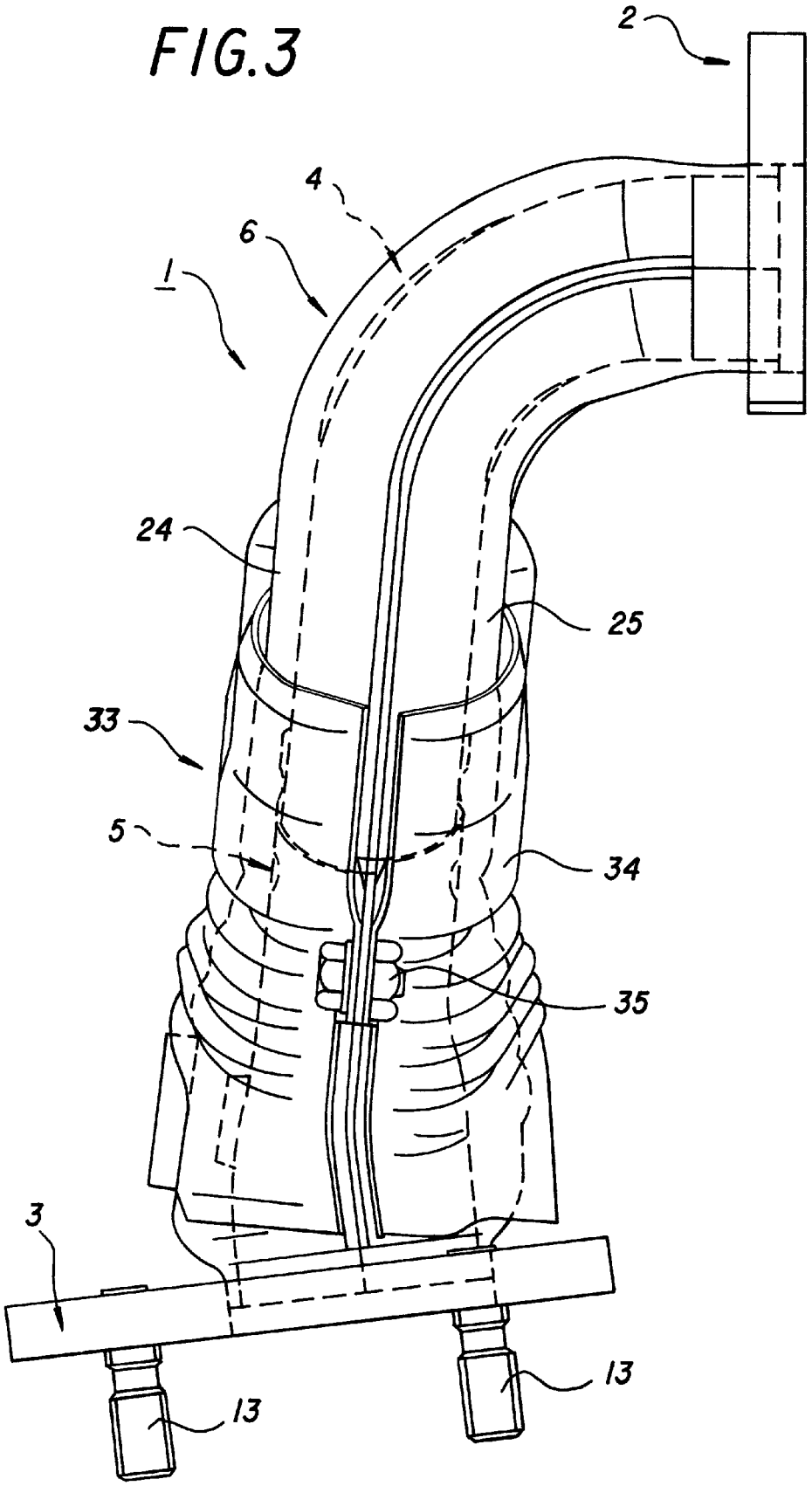
FIG. 3 is a side view thereof.

Hereinafter, a preferred embodiment of the present invention will be described with reference to FIGS. 1 to 6. The exhaust manifold 1 is one to be used in an in-line, 4 cylinder, 4 stroke cycle internal combustion engine for a motorcar. The exhaust manifold 1 comprises an upper stream flange 2 made of steel, a lower stream flange 3 made of steel, four manifold pipes 4 made of stainless steel, a manifold chamber 4 ( the aforesaid gathering section made of a plate metal) and a manifold case 6 of stainless steel (the aforesaid case covering the manifold pipes and gathering section).

The upper stream flange 2 has four holes 10 to be connected to respective exhaust ports of the internal combustion engine (not shown) and bolt holes 11 for bolts to be screwed to a cylinder head. The lower stream flange 3 has a hole 12 to be connected to an exhaust pipe (not shown), screw holes 14 into which male screws 13 penetrating through a flange at an upper stream end of the exhaust pipe is screwed, and bolt holes 15 for connecting the flange 3 to a cylinder block through a bracket (not shown).

The manifold chamber 5 is formed by joining an obverse side chamber half 18 and a reverse side chamber half 19 together. The chamber halves 18, 19 are welded to each other at upper stream ends 20 thereof to be connected integrally. The manifold chamber 5 has branched upper stream ends having openings respectively and lower stream ends of the manifold pipes 4 are fitted into the respective openings so as to slide relatively.

Figure 4:
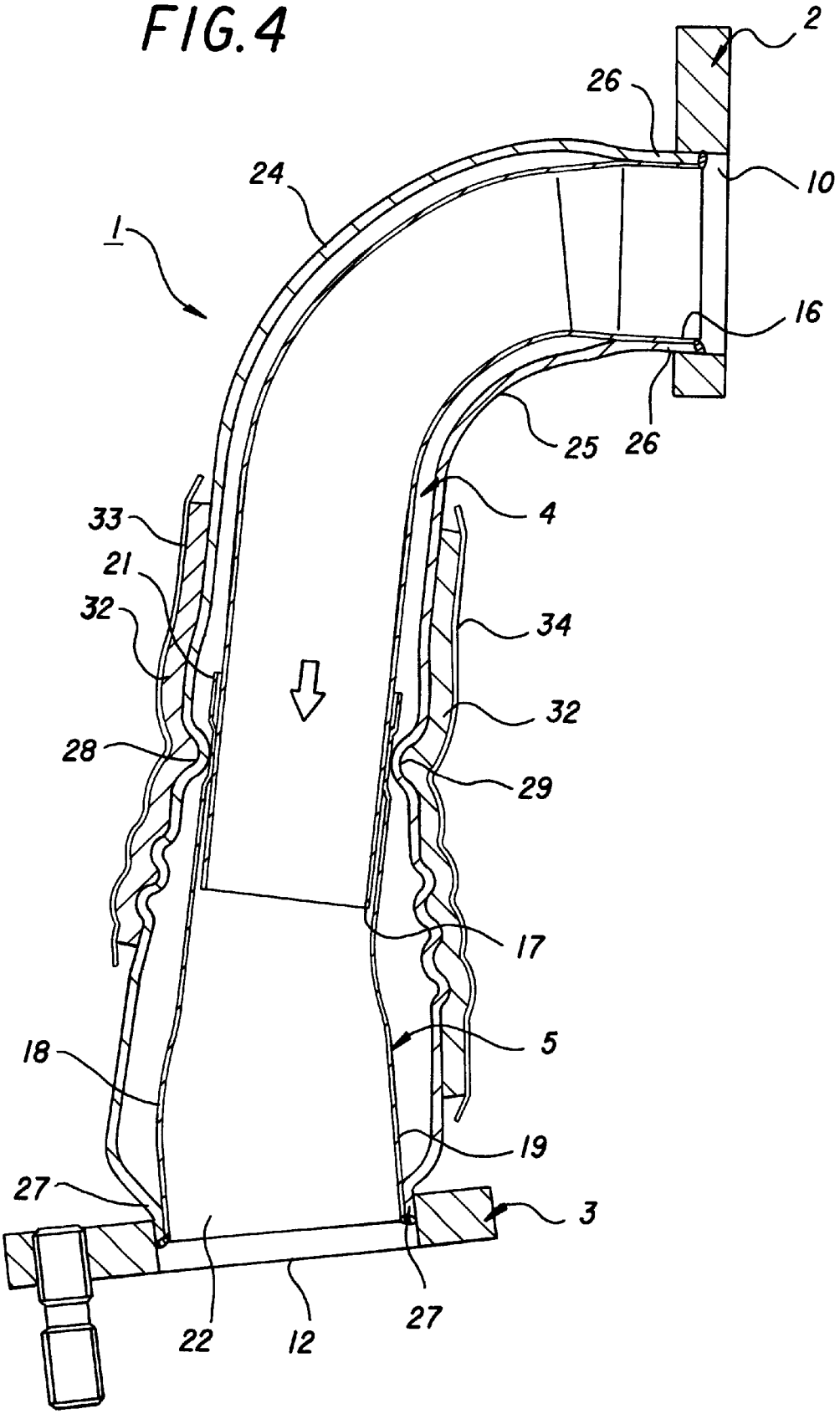
FIG. 4 is a longitudinal section along the line IV—IV of FIG. 1.
Figure 5:
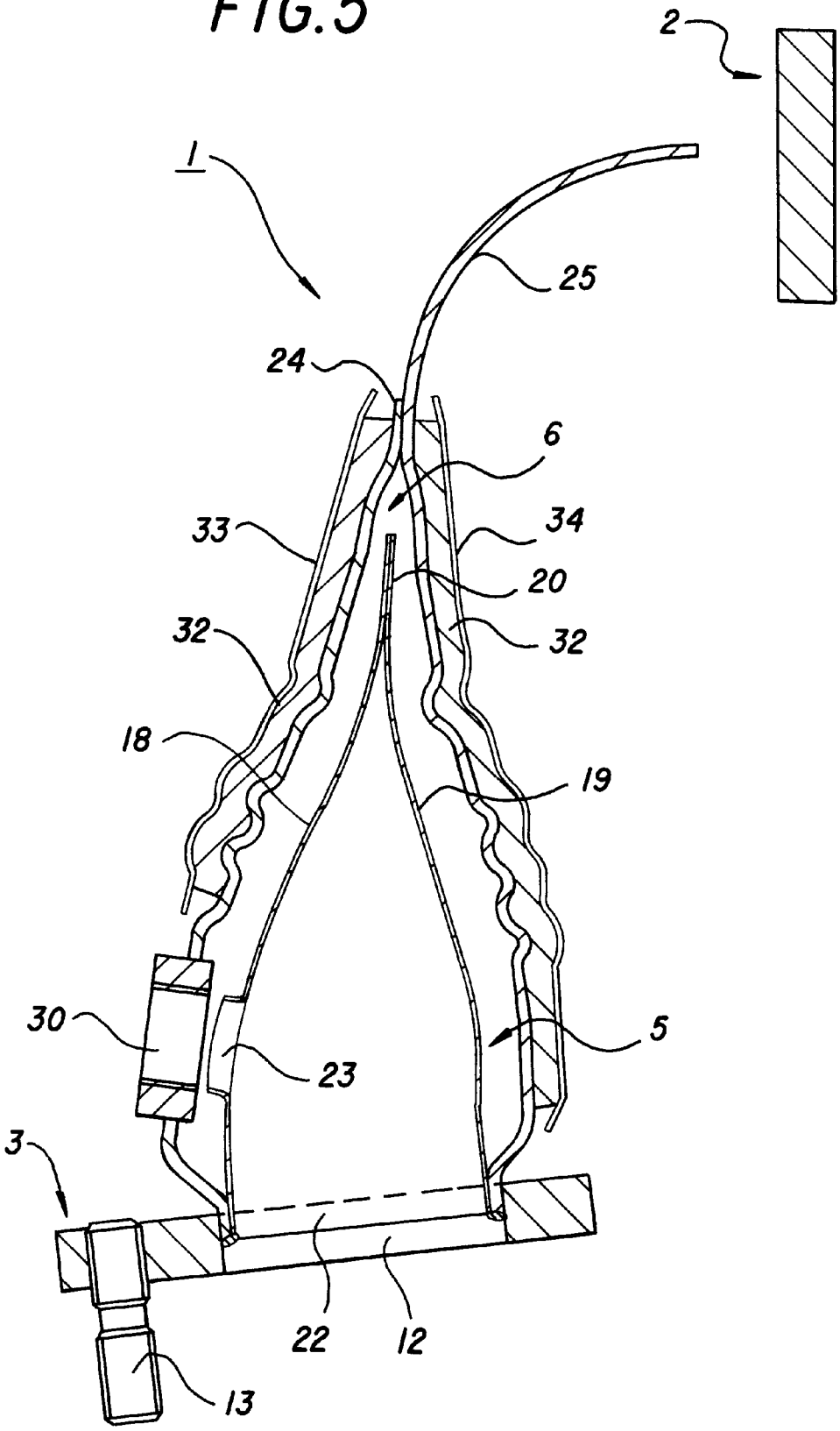
FIG. 5 is a longitudinal section along the line V—V of FIG. 1.
Figure 6:
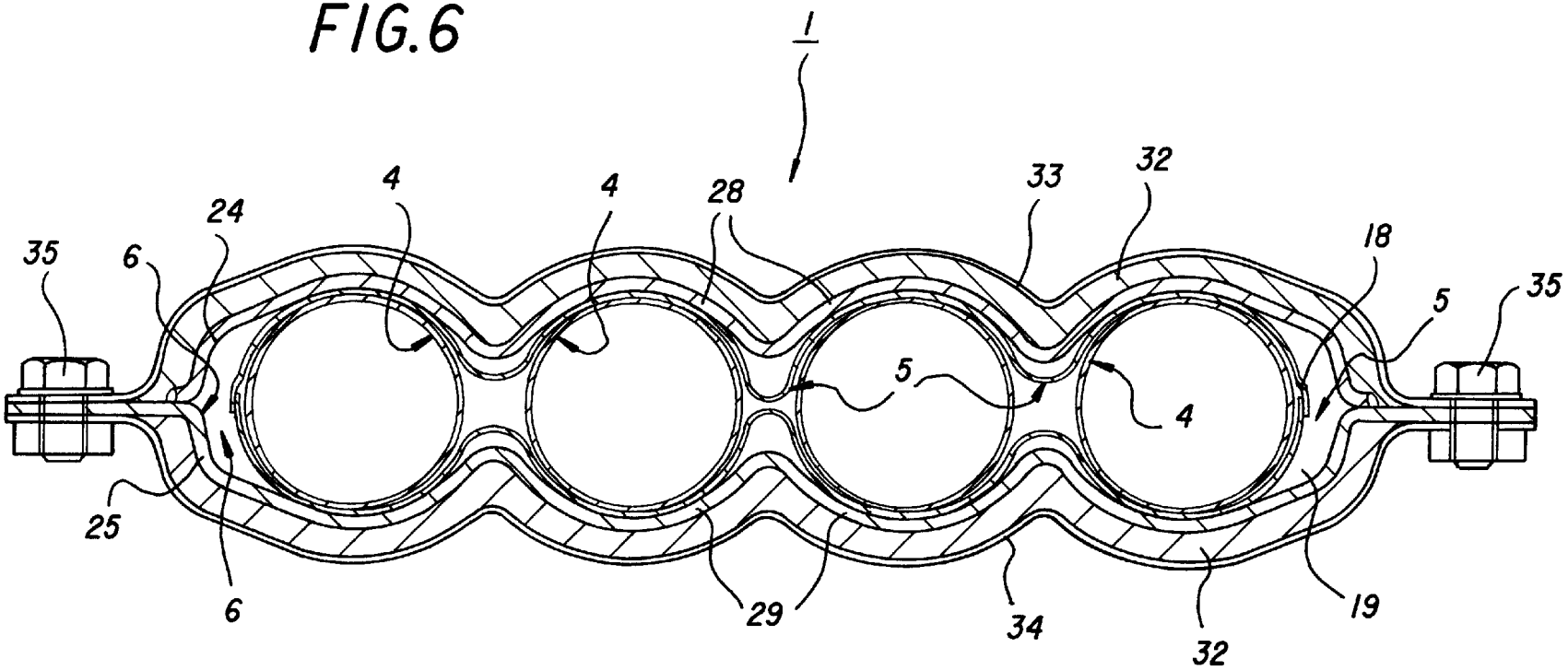
FIG. 6 is a section along the line VI—VI of FIG. 1.

The manifold case 6 is also formed by joining an obverse side case half 24 and a reverse side case half 25 together. The case halves 24, 25 are welded to each other along an abutting outer periphery as shown by the thick line in FIG. 5 to be connected integrally. The manifold case 6 has branched upper stream ends tightly contacted with respective upper stream ends of the manifold pipes 4 and fitted into communication holes 10 of tue upper stream flange 2. The hole 10 of the upper stream flange 2, the upper stream end of the manifold pipe 4 and the branched upper stream end 26 of the manifold case 6 are connected to each other by welding as shown in FIG. 4. The manifold case 6 has a gathering lower end 27 tightly contacted with an outer periphery of a gathering lower stream open end 22 of the manifold chamber 5 and fitted into the hole 12 of the lower stream flange 3. The hole 12 of the lower stream flange 3, the gathering lower stream open end 22 of the manifold chamber 5 and the gathering lower end 27 of the manifold case 6 are connected to each other by welding as shown in FIGS. 4, 5. An outer side of a fitting portion of the manifold pipe 4 and the manifold chamber 5 is pressed by inwardly bent parts 28, 29 of the obverse and reverse side case halves 24, 25 of the manifold case 6.

As shown in FIG. 5, a sensor fitting hole 23 is formed at a gathering lower stream portion of the obverse side chamber half 18 of the manifold chamber 5, and the obverse side case half 24 of the manifold case 6 has a sensor fitting hole 30 formed at a position corresponding to the sensor fitting hole 23. A detecting member of an $O_2$ sensor (not shown) projects into the manifold chamber 5 through the sensor fitting holes 23, 30.

The holes $\mathbf{10}_1$, $\mathbf{10}_2$, $\mathbf{10}_3$ and $\mathbf{10}_4$ of the upper stream flange 2 communicates with exhaust ports of first, second, third and fourth cylinders of a not shown internal combustion engine and the manifold pipes $\mathbf{4}_1$, $\mathbf{4}_2$, $\mathbf{4}_3$ and $\mathbf{4}_4$ are connected with the holes $\mathbf{10}_1$, $\mathbf{10}_2$, $\mathbf{10}_3$ and $\mathbf{10}_4$ respectively. As obvious from FIG. 1, the first and fourth holes $\mathbf{10}_1$, $\mathbf{10}_4$ are arranged at a distance away from the hole 12 of the lower stream flange 3 so that the lower stream ends $\mathbf{17}_1$, $\mathbf{17}_4$ of the manifold pipes $\mathbf{4}_1$, $\mathbf{4}_4$ open into the manifold chamber 5 at a position far from the hole 12 compared with the lower stream ends $\mathbf{17}_2$, $\mathbf{17}_3$ of the second and third manifold pipes $\mathbf{4}_2$, $\mathbf{4}_3$.

A heat-resistant sound absorbing material 32 such as glass wool is applied on an outer peripheral surface of the manifold case 6 and covered with obverse and reverse manifold covers 33, 34 which are joined together by bolts and nuts 35.

According to the embodiment shown in FIGS. 1 to 6, when an internal combustion engine (not shown) is started, high temperature exhaust generated in each cylinder of the engine is discharged from an exhaust port of the engine to an exhaust pipe (not shown) through the communication hole 10 of the upper stream flange 2, the manifold pipe 4, the manifold chamber 5 and the communication hole 12 of the lower stream flange 3.

At the time when the engine is started, the exhaust manifold 1 is in a low temperature state and absorbs heat of the exhaust to cool it. However, the manifold pipe 4, the manifold chamber 5 and the manifold case 6 are made of thin plate metals so that heat capacity of the exhaust manifold 1 is small, and the combined manifold pipe and manifold chamber 4, 5 and the manifold case 6 form a double construction with a space between so that the exhaust manifold 1 has a good insulating nature. Therefore, the exhaust is not cooled so much, an exhaust cleaning catalyst in the exhaust pipe can be activated immediately, and it can be avoided that the initial performance of the exhaust cleaning catalyst on starting is lowered.

An exhaust passage within the manifold case 6 is composed of two parts arranged in the direction of the passage, that is the manifold pipe 4 and the manifold chamber 5, and the lower stream end 17 of the manifold pipe 4 is fitted into the upper stream open end 21 of the manifold chamber 5 so as to slide. Therefore, though the manifold pipe 4 and the manifold chamber 5 are heated to a higher temperature compared with the manifold case 6, and heat expansions of the manifold pipe 4 and the manifold chamber 5 are larger than that of the manifold case 6, the difference of the heat expansions is absorbed by relative sliding of the manifold pipe 4 and the manifold chamber 5 so that it is prevented that large thermal stresses are generated in the manifold pipe 4, the manifold chamber 5 and the manifold case 6.

Though the lower stream end 17 of the manifold pipe 4 and the upper stream open end 21 of the manifold chamber 5 are fitted so as to slide relatively, the sliding fit portion is pressed inwardly by the bent parts 28, 29 of the case halves 24, 25, so that even if vibration generated at an internal combustion engine is transmitted to the exhaust manifold 1, vibration of the sliding fit portion between the lower stream end 17 of the manifold pipe 4 and the upper stream end 21 of the manifold chamber 5 is restrained surely.

In the four cylinders of the internal combustion engine, ignitions take place at regular intervals in order of first, third, fourth and second cylinders. On the other hand, the open ends $17_1$, $17_4$ of the manifold pipes $4_1$, $4_4$ corresponding to the first and fourth cylinders and the open ends $17_2$, $17_3$ of the manifold pipes $4_2$, $4_3$ corresponding to the second and third cylinders are arranged at places shifted mutually. Therefore, no exhaust interference occurs, dynamic effect of exhaust is exhibited sufficiently, suction efficiency increases indirectly, and engine output and efficiency can be improved.

Since the manifold case 6 closes around the manifold pipes 4 and the manifold chamber 5 airtightly, even if the fit portion where the lower stream end 17 of the manifold pipe 4 is fitted into the upper stream open end 21 of the manifold chamber 5 so as to slide is not airtight, leak of the exhaust can be prevented.

Since the lower stream ends 17 of the manifold pipes 4 project into a central part of the manifold chamber 5 having an inner space reduced toward the lower stream and opened toward the gathering lower stream end of the manifold chamber 5, the exhaust is straightened and flows within the exhaust manifold 1 smoothly without causing a large turbulence and suction efficiency can be improved due to lowering of exhaust resistance.

An insulating air layer is formed between the manifold pipes 4—manifold chamber 5 and the manifold case 6, and further the sound absorbing material 32 and the manifold covers 33, 34 cover the fit portion of the manifold pipe 4 and the manifold chamber 5 which becomes at high temperature and is liable to generate a large sound. Therefore, heat insulating and temperature keeping nature of the exhaust manifold 1 is ensured and a high sound absorbing effect is obtainable.

The manifold pipe 4 and the manifold chamber 5 which form the exhaust passage are perfectly isolated from the manifold case 6 with the exception of the upper stream end 16, the gathering lower stream open end 22 and the bent parts 28, 29, to form an insulating air layer between the manifold pipe 4—manifold chamber 5 and the manifold case 6. Therefore, heat transfer to the manifold case 6 from the manifold pipe 4 and the manifold chamber 5 is restrained, lowering of the exhaust temperature at a time immediately after start of the internal combustion engine is avoided, and radiant heat from the manifold case 6 to the exterior is restrained to maintain atmospheric temperature within an engine room low.

Since the manifold pipes $4_1$, $4_2$, $4_3$, $4_4$ can slide freely with respect to the manifold chamber 5 respectively, generation of thermal stress due to thermal contraction is restrained, generation of stress due to vibration is also restrained and durabilities of the manifold pipe 4 and the manifold chamber 5 are improved.

The sound absorbing material 32 and the manifold cover 33, 34 cover the outer periphery of the manifold chamber 5 which exhausts from every cylinders gather to, reaches the highest temperature and generates large sounds, so that noise level within the engine room is reduced largely.

Figure 7:
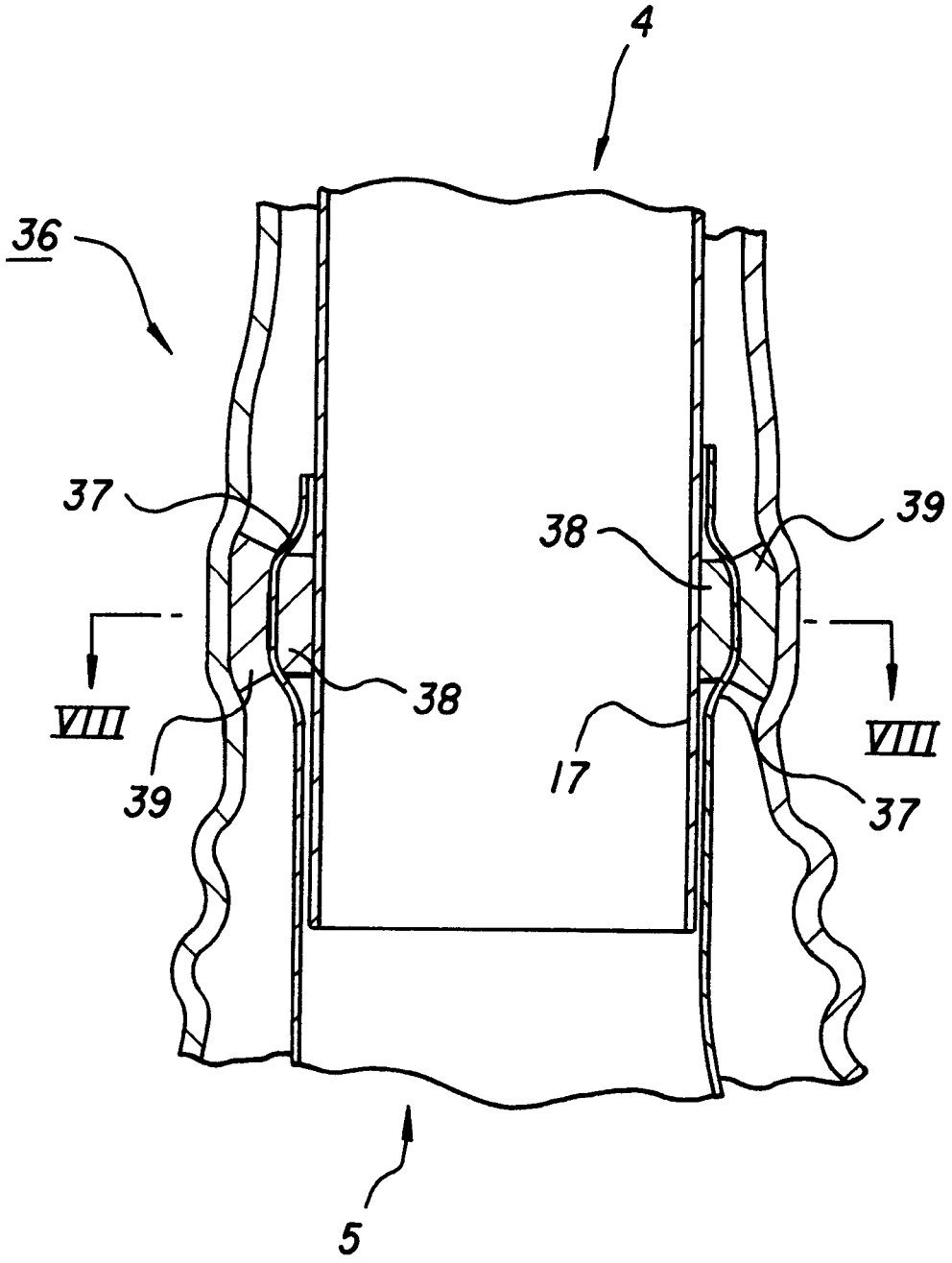
FIG. 7 is an enlarged longitudinal section showing an essential part of a variation.
Figure 8:
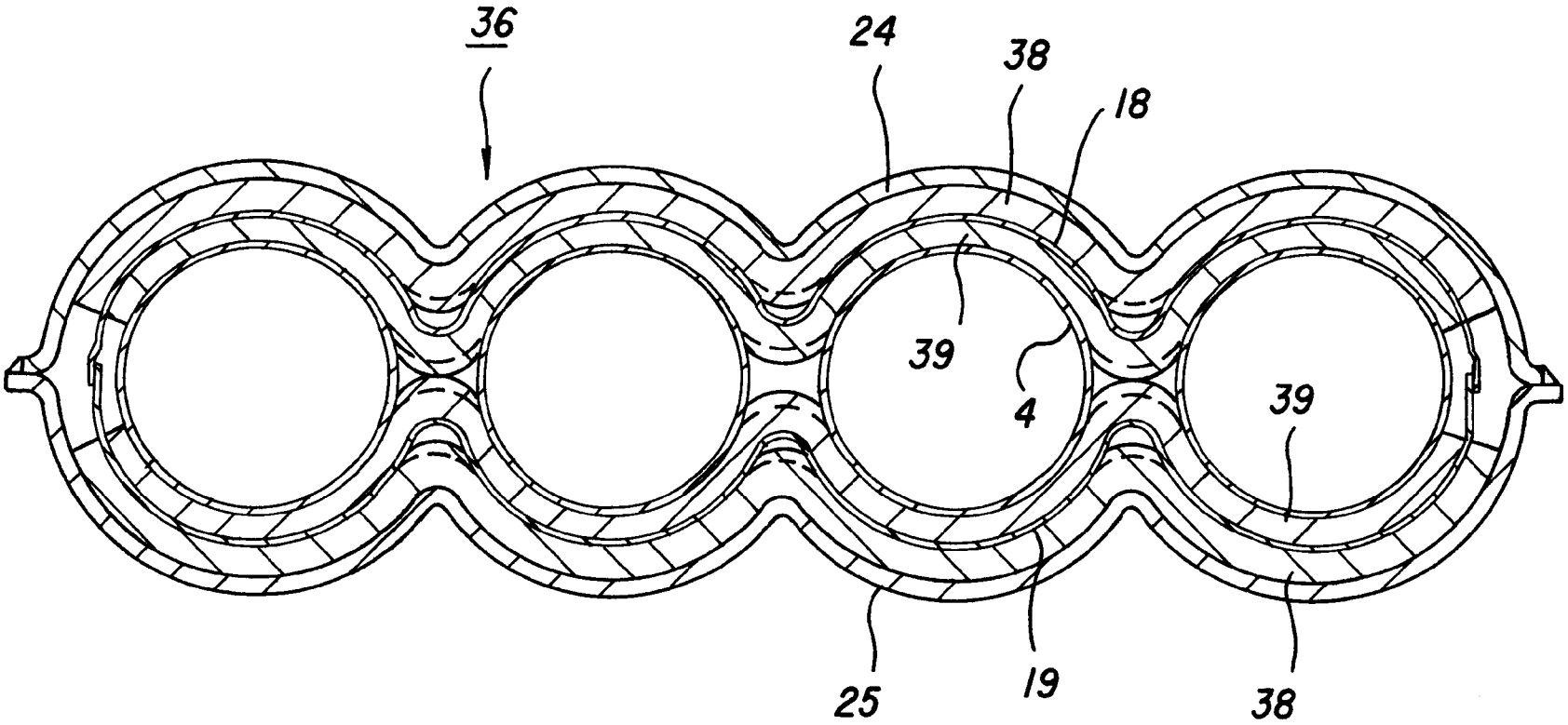
FIG. 8 is a cross section along the line VIII—VIII of FIG. 7.

FIGS. 7, 8 show a variation of the above-mentioned embodiment. In this exhaust manifold 36, a branched upper stream portion 37 of the manifold chamber 5 is swelled outward and a steel mesh 38 is put between the branched upper stream portion 37 and the lower stream end 17 of the manifold pipe 4. In addition, another steel mesh 39 may be put between the branched upper stream portion 37 and the manifold case 6, too. According to the variation, sliding of the manifold pipe 4 and the manifold chamber 5 at the fit portion can be carried out more smoothly while keeping good heat insulating property.

In order to fix the meshes 38, 39 surely and prevent dropping out thereof, the meshes 38, 39 may be fixed by spot welding or recesses capable of receiving the meshes 38, 39 may be formed on the manifold case 6, the manifold pipe 4 or the manifold chamber 5.

Figure 10:
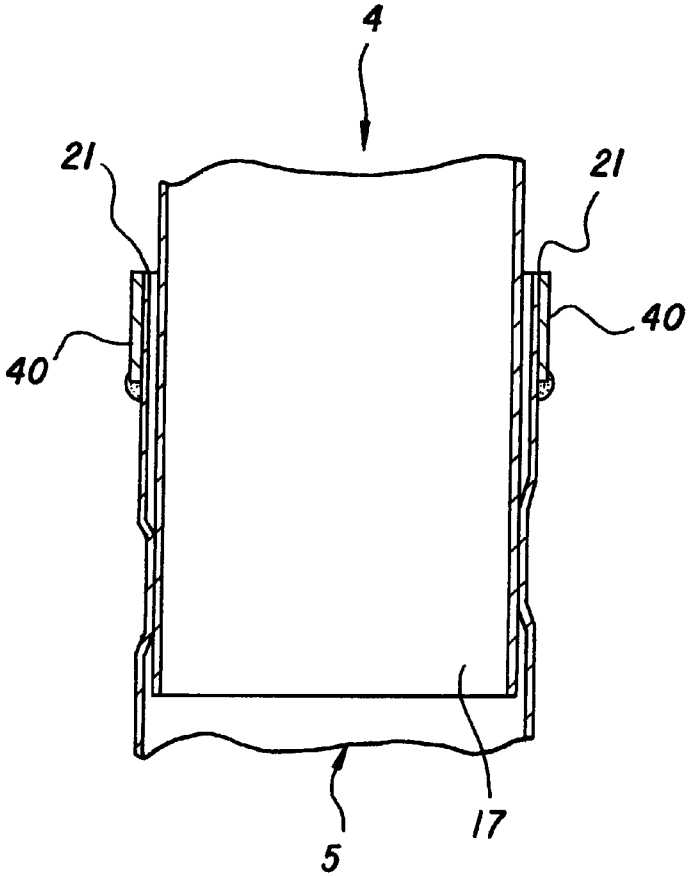
FIG. 10 is a longitudinal section along the line X—X of FIG. 9.
Figure 9:
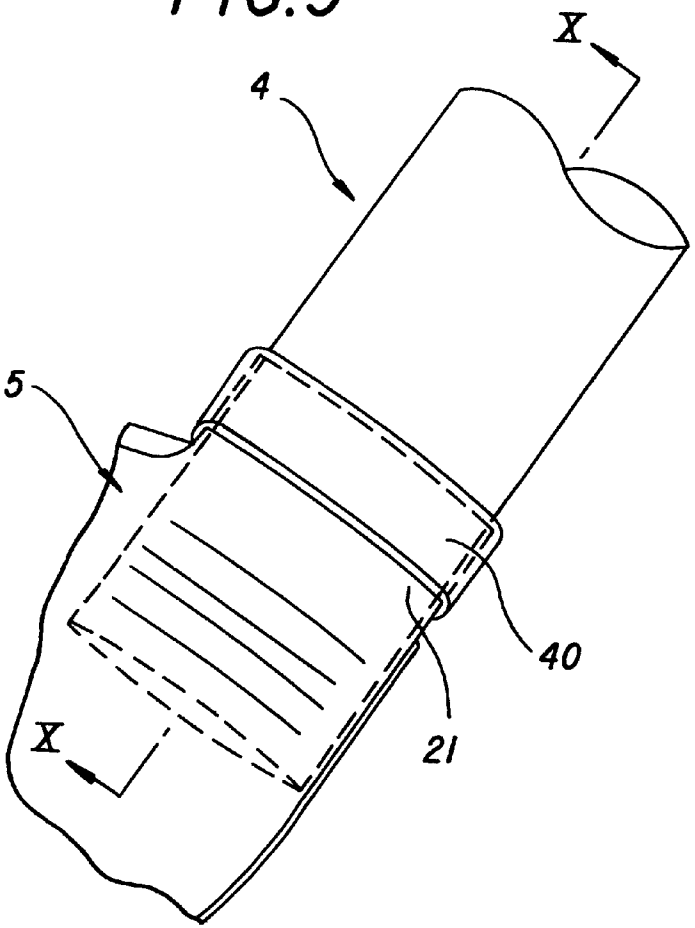
FIG. 9 is an enlarged front view showing an essential part of another variation wherein a manifold case is removed.

FIGS. 9, 10 show another variation in which a reinforcing short pipe 40 is fitted and welded on an outer periphery of the branched upper stream open end 21 of the manifold chamber 5. Strength of the branched upper stream open end 21 of the manifold chamber 5 is increased and durability thereof is improved.

Figure 11:
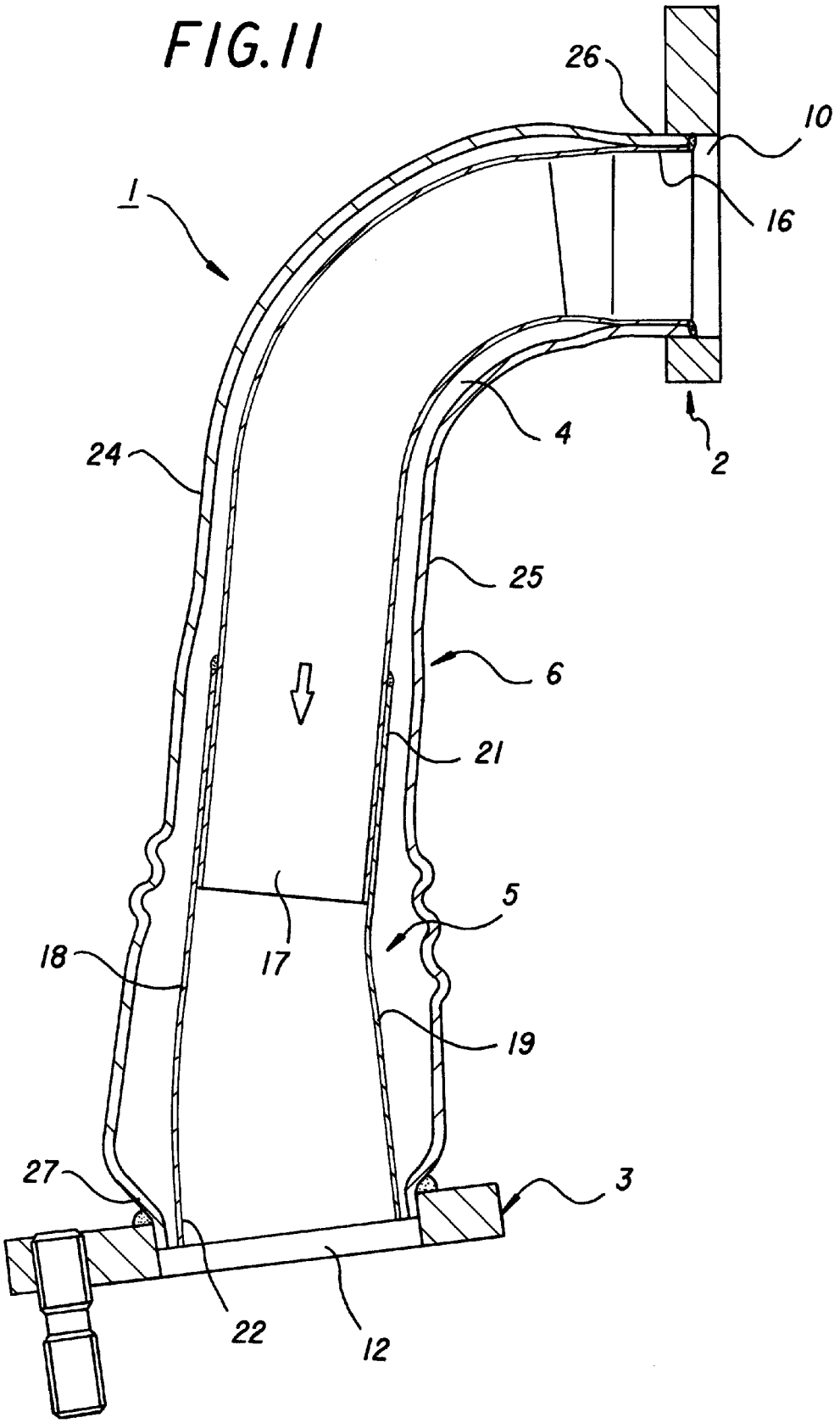
FIG. 11 is a longitudinal section similar to FIG. 4 showing another embodiment of the present invention.
Figure 12:
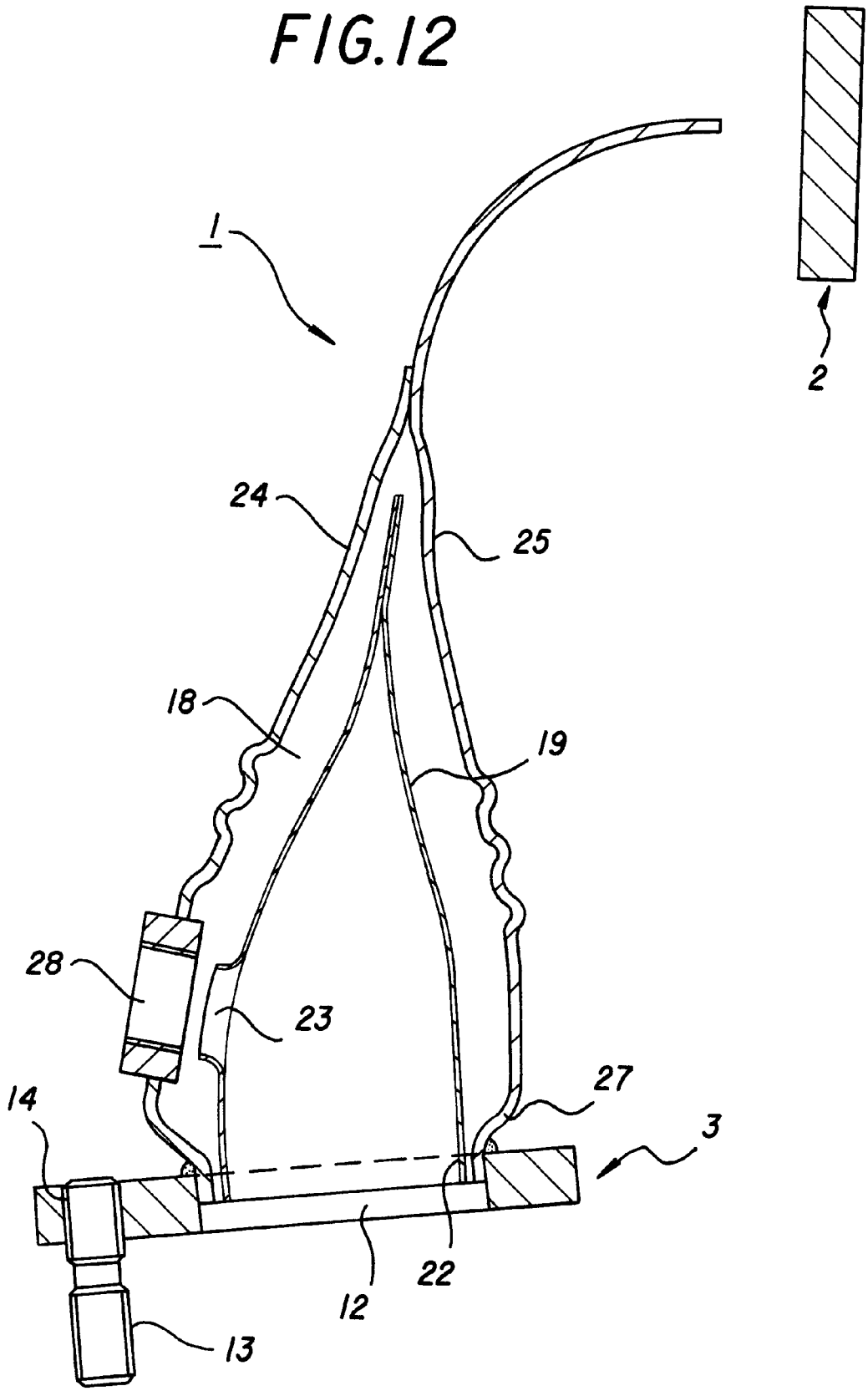
FIG. 12 is a longitudinal section similar to FIG. 5 thereof.

FIGS. 11, 12 are views similar to the above-mentioned FIGS. 4, 5 but showing another embodiment of the present invention. In these FIGS. 11, 12 and 4, 5, similar parts are denoted by the same numerals. The exhaust manifold 1 of this embodiment has not the aforesaid sound absorbing material 32 and manifold cover 33, 34. Further, the lower stream portion 17 of the manifold pipe 4 and the branched upper stream open end 21 of the manifold chamber 5 are connected integrally by welding. The gathering lower stream end 27 of the manifold case 6 is fitted into the communication hole 12 of the lower stream flange 3 and welded thereto. The gathering lower stream open end 22 is loosely fitted into the gathering lower stream end 27 of the manifold case 6 with a space between and able to move relatively to the end 27 of the case 6.

The manifold pipe 4 and the manifold chamber 5 are directly contacted with the exhaust of high temperature and heated to a high temperature while the manifold case 6 contacted with the atmosphere is not heated to so high temperature and kept at a low temperature. Therefore, amount of thermal expansion of the manifold pipe 4 and the manifold chamber 5 is larger than that of the manifold case 6. In this embodiment, the difference of the amounts of thermal expansion is absorbed by relative movement of the gathering lower stream open end 22 of the manifold chamber 5 and the gathering lower stream end 27 of the manifold case 6 to prevent that large thermal stresses occur in the manifold pipe 4, the manifold chamber 5 and the manifold case 6. Moreover, as a result of absorbing thermal expansions in such a manner, firm connection and rigidity at the fit portion between the lower stream portion of the manifold pipe 4 which becomes at a high temperature and the gathering upper stream open portion 21 of the manifold chamber which becomes at the highest temperature is ensured and durability of the manifold pipe 4 and the manifold chamber 5 can be improved.

Though the gathering lower stream open end 22 of the manifold chamber 5 is fitted to the gathering lower end 27 of the manifold case 6, since the four branched upper stream open ends $21_1$, $21_2$, $21_3$, $21_4$ are fixedly supported firmly and stably being welded to the four manifold pipes $4_1$, $4_2$, $4_3$, $4_4$ which are integrally connected to the upper stream flange 2 at their upper stream ends 16 respectively, vibration of the fit portion between the gathering lower stream open end 22 of the manifold chamber 5 and the gathering lower stream end 27 of the manifold case 6 is restrained as possible when a vibration generated on the internal combustion engine is transmitted to the exhaust manifold 1. Also, the fit portion between the lower stream portion of the manifold pipe 4 and the branched upper stream open portion 21 of the manifold chamber 5 is made rigid as mentioned above. Therefore, the fit portion is prevented from damage due to the vibration transmitted from the internal combustion engine, effectively.

The part where the lower stream portions 17 of the manifold pipes 4 and the branched upper stream open ends of the manifold chamber 5 are connected with each other is liable to generate intense noise because of exhaust gathering there, but the lower stream portions 17 and the branched upper open ends 21 are fitted and integrally connected by welding for preventing vibration, further the exterior of the part is covered by the manifold case with a space between, so that noise of the exhaust hardly leaks out.

Since walls of the manifold pipe 4, the manifold chamber 5 and the manifold case 6 are thin, it is possible to lighten the exhaust manifold 1.

Figure 13:
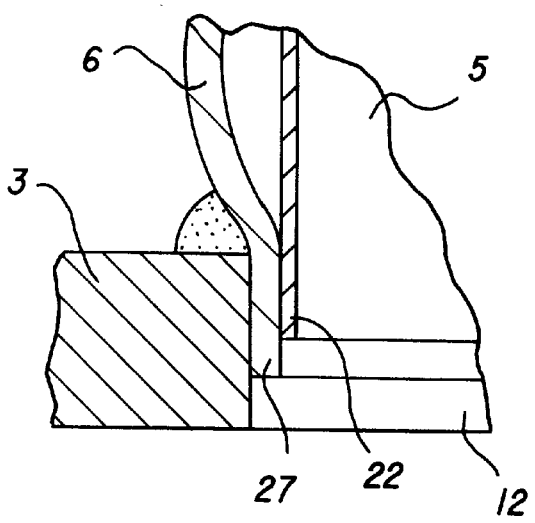
FIG. 13 is a partial enlarged longitudinal section view showing another variation.

In the embodiment of FIGS. 11, 12, there is a space between the gathering lower stream open end 22 of the manifold chamber 5 and the gathering lower stream end 27 of the manifold case 6. But, as shown in FIG. 13, the open end 22 and the end 27 may be contacted with each other so as to slide.

Figure 14:
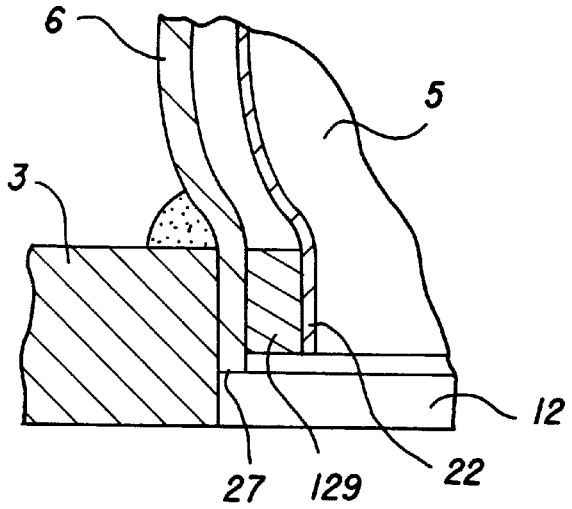
FIG. 14 is a view similar thereto showing further another variation.

As shown in FIG. 14, a steel or stainless steel mesh 129, a ceramic fiber or a heat insulating spring may be put between the gathering lower open end 22 of the manifold chamber 5 and the gathering lower stream end 27 of the manifold case 6. In such a manner, the gathering lower stream open end 22 of the manifold chamber 5 can be supported by the gathering lower stream end 27 of the manifold case 6 elastically and stably to improve vibration-resistance still more.

Figure 15:
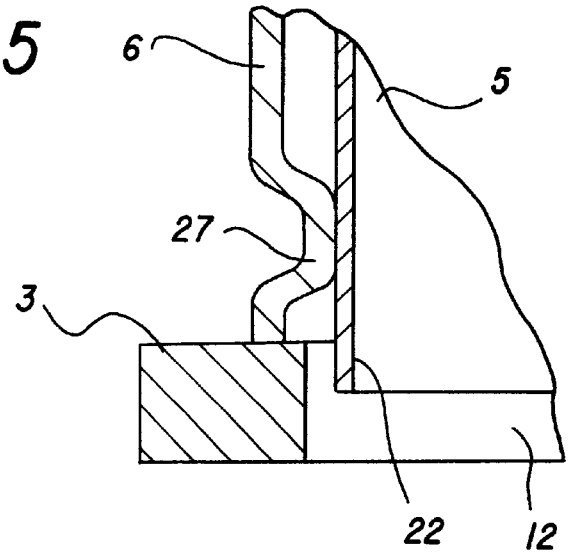
FIG. 15 is a view similar thereto showing the other variation.

As shown in FIG. 15, a part of the manifold case 6 near the gathering lower stream end 27 may be caulked to hold the gathering lower stream open end 22 of the manifold chamber 5 more stably.

Figure 16:
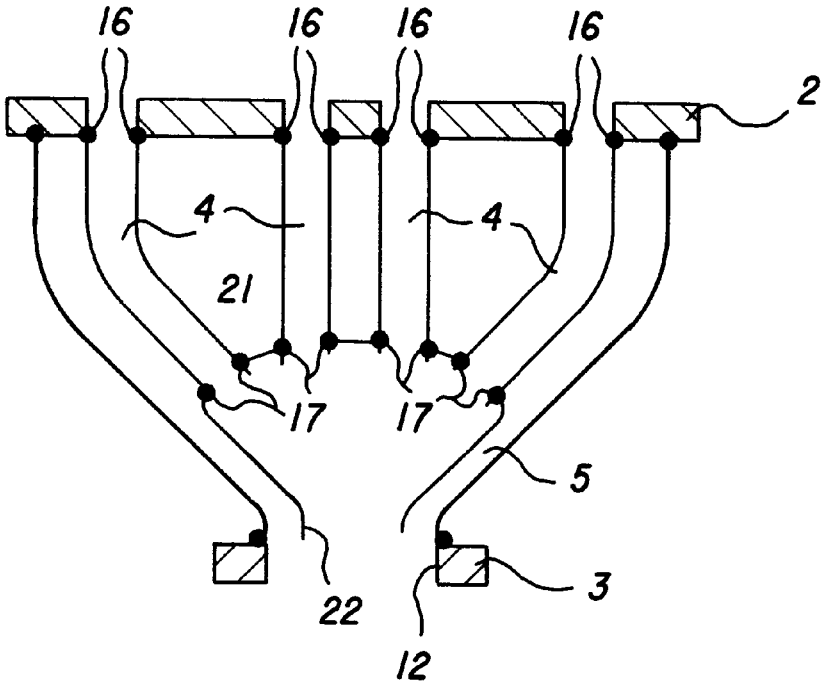
FIG. 16 is a rough sketch showing an embodiment of the present invention.

In the embodiment of FIGS. 11, 12, as shown in FIG. 16 by a rough sketch, all of the upper stream ends 16 and the lower stream portions 17 of the manifold pipes 4 are welded to the upper stream flange 2 and the branched upper stream open ends 21 of the manifold chamber 5 respectively. Alternatively, in an exhaust manifold shown in FIG. 17, the lower stream portions $\mathbf{17}_2$, $\mathbf{17}_3$ of the manifold pipes $\mathbf{4}_2$, $\mathbf{4}_3$ are welded to the branched upper stream open ends $\mathbf{21}_2$, $\mathbf{21}_3$ of the manifold chamber 5 and the lower stream portions $\mathbf{17}_1$, $\mathbf{17}_4$ of the manifold pipes $\mathbf{4}_1$, $\mathbf{4}_4$ are movably fitted into the branched upper stream open ends $\mathbf{21}_1$, $\mathbf{21}_4$ of the manifold chamber 5, while all upper stream ends 16 of the manifold pipes 4 are welded to the upper stream flange 2. According to this constitution, even if there is a difference of thermal expansion between the manifold pipes $\mathbf{4}_1$, $\mathbf{4}_4$ and the manifold pipes $\mathbf{4}_2$, $\mathbf{4}_3$ the difference of thermal expansion is absorbed by the lower stream portions $\mathbf{17}_1$, $\mathbf{17}_4$ of the manifold pipes $\mathbf{4}_1$, $\mathbf{4}_4$ moving relatively to the branched upper stream open ends $\mathbf{21}_1$, $\mathbf{21}_4$ of the manifold chamber 5 so that thermal stress occurring in the manifold pipes 4 due to the difference of thermal expansion can be prevented.

Figure 17:
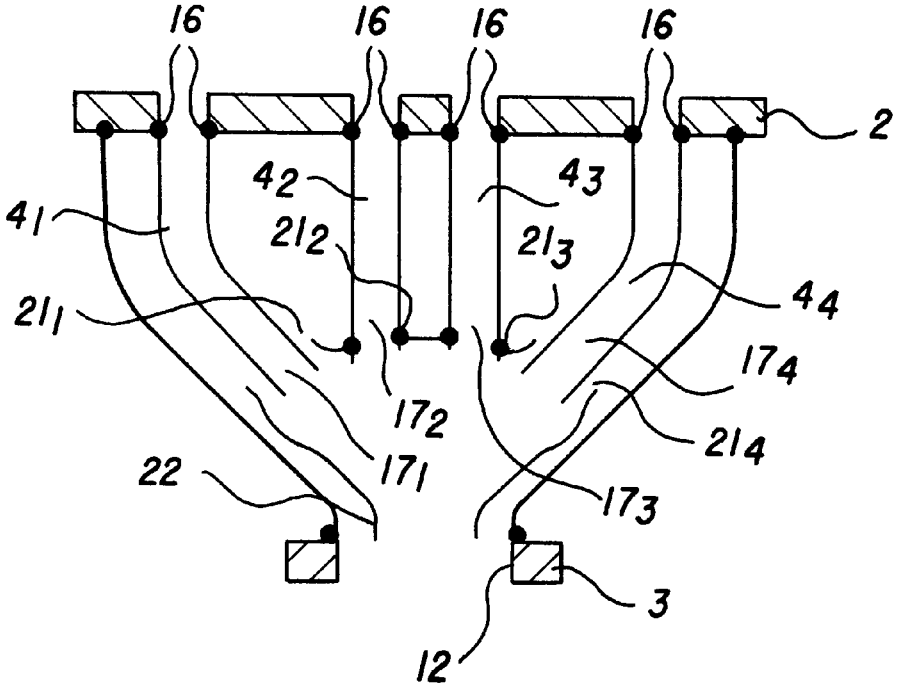
FIG. 17 is a rough sketch showing another embodiment.
Figure 18:
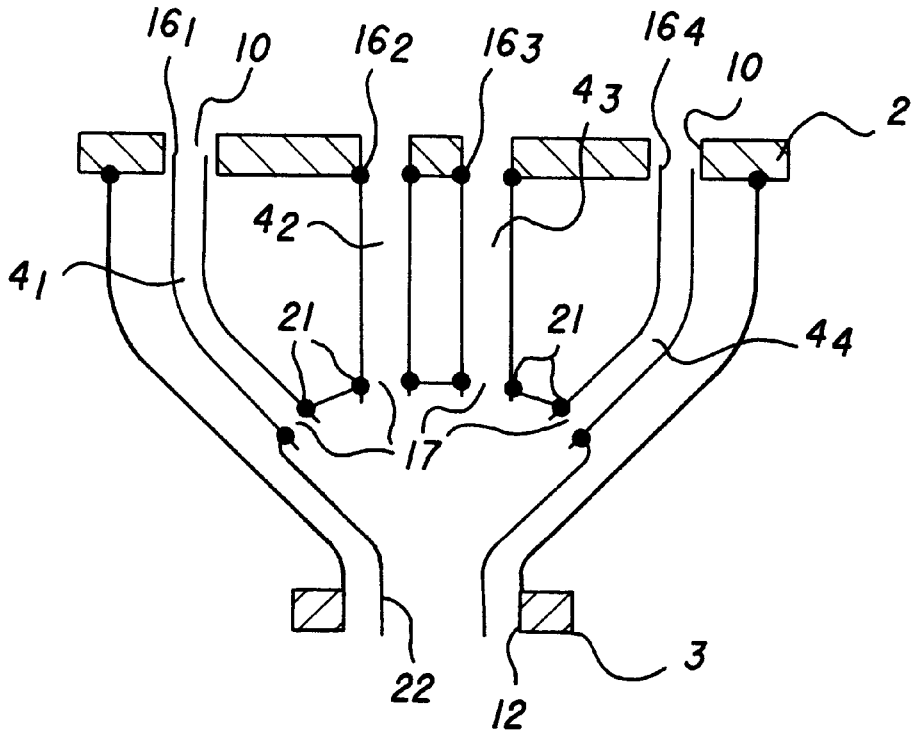
FIG. 18 is a rough sketch showing further another embodiment.

In another embodiment shown in FIG. 18, the upper stream ends $\mathbf{16}_2$, $\mathbf{16}_3$ of the manifold pipes $\mathbf{4}_2$, $\mathbf{4}_3$ are welded to the upper stream flange 2 and the upper stream ends $\mathbf{16}_1$, $\mathbf{16}_4$ of other manifold pipes $\mathbf{4}_1$, $\mathbf{4}_4$ are movably fitted into the holes 10 of the upper stream flange 2, while all lower stream portions 17 of the manifold pipes 4 are welded to the branched upper stream open ends 21 of the manifold chamber 5 which has the gathering lower stream end 22 movably fitted to the hole 12 of the lower stream flange 3. This embodiment exhibits the same function and effect as those of the embodiment of FIG. 17.

Figure 19:
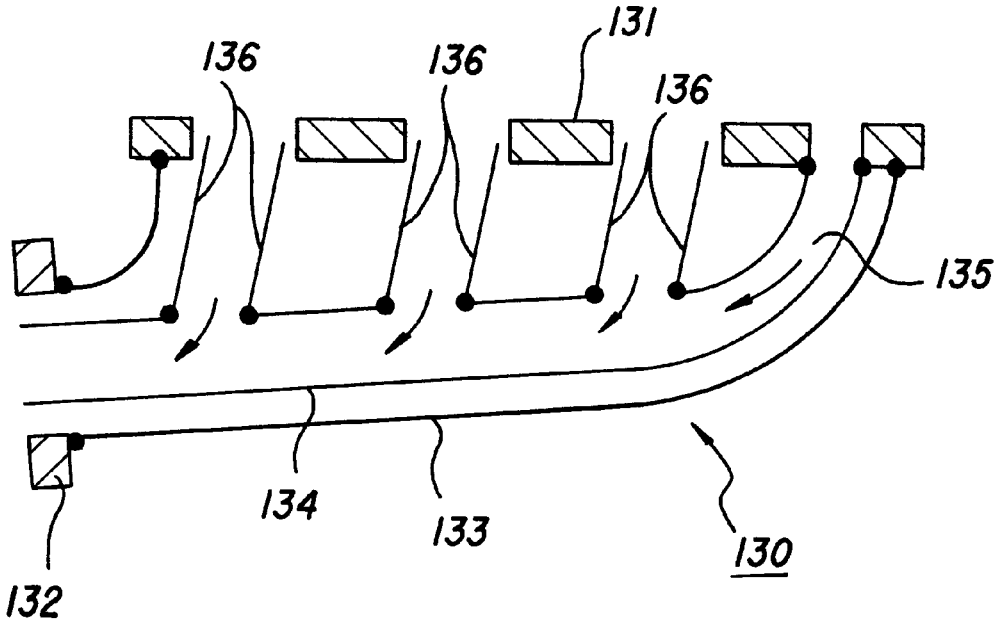
FIG. 19 is a rough sketch showing the other embodiment.

According to further another embodiment shown in FIG. 19, an exhaust manifold 130 has a lower stream flange 132 directed perpendicularly to an upper stream flange 131 which is directed in parallel with a row of cylinders of an internal combustion engine and both upper stream and lower stream ends of an outer member (case) 133 obliquely inclined from the lower stream flange 132 toward the upper stream flange 131 are integrally connected to the upper stream and lower stream flanges 131, 132 respectively. Within the outer member 133 is arranged an inner member (gathering section) 134 with a space between. The inner member 134 has lateral openings to which lower stream ends of manifold pipes 136 are welded and a tip end pipe 135 with an upper stream end welded to the upper stream flange 131. Upper stream ends of the manifold pipes 136 are movably fitted to the upper stream flange 131 and a lower stream end of the inner member 134 is movably fitted to the lower stream flange 132. According to this embodiment, it is possible to prevent deterioration of durability of the exhaust manifold 130 due to occurrence of thermal stress, by effectively absorbing thermal expansion difference between the outer member 133 and the inner member 134 and between the tip end pipe 135 and the manifold pipe 136, as well as the same effect as the embodiments of FIGS. 16 to 18 is obtainable.

Figure 20:
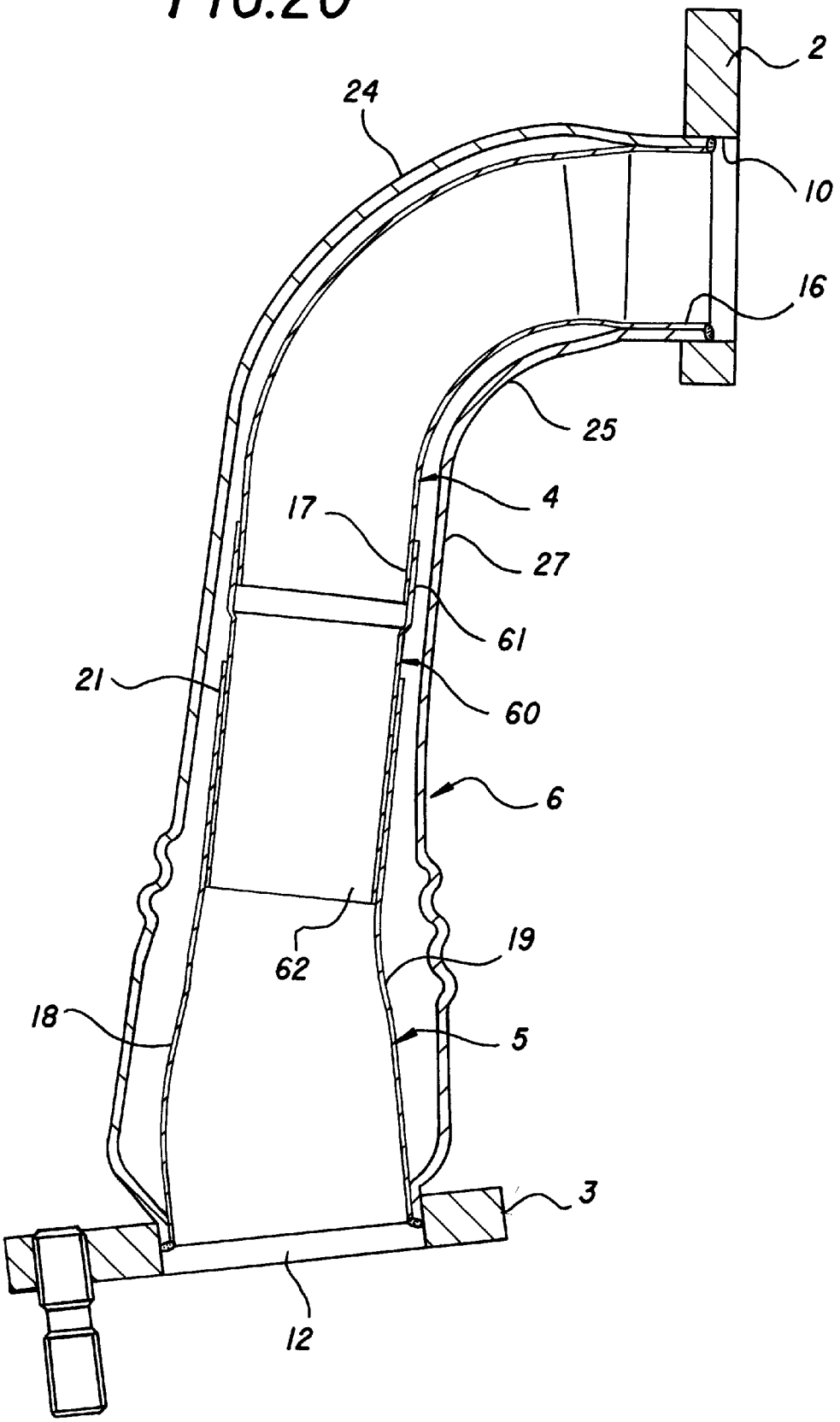
FIG. 20 is a longitudinal section similar to FIG. 4 showing further another embodiment of the present invention.

FIG. 20 is a view similar to the above-mentioned FIG. 4 for showing the other embodiment of the present invention. In FIGS. 20 and 4, similar parts are denoted by the same numerals. Like the aforementioned embodiments, the manifold chamber 5 is formed by joining a press-shaped obverse side chamber half 18 and a press-shaped reverse side chamber half 19 together, with upper stream ends welded to each other to be connected integrally. A lower stream small diameter section 62 of a guide pipe (connecting pipe) 60 is fitted and welded to the branched upper stream open end 21 of the manifold chamber 5, and the lower stream end 17 of the manifold pipe 4 is fitted into an upper stream large diameter section 61 of the guide pipe 60 so as to slide relatively.

The lower stream portion 17 of the manifold pipe 4 is held so as not to move in the direction perpendicular to the longitudinal direction of the manifold pipe 4 by the upper stream large diameter section 61 of the guide pipe 60 which is firmly fixed to the manifold chamber 5 by the lower stream small diameter section 62 welded to the upper stream open end 21 over all circumference. Therefore, even if vibration of an internal combustion engine is transmitted to the exhaust manifold, vibration of the manifold pipe 4 in the direction perpendicular to the longitudinal direction of the pipe 4 is effectively restrained by the guide pipe 60.

Figure 21:
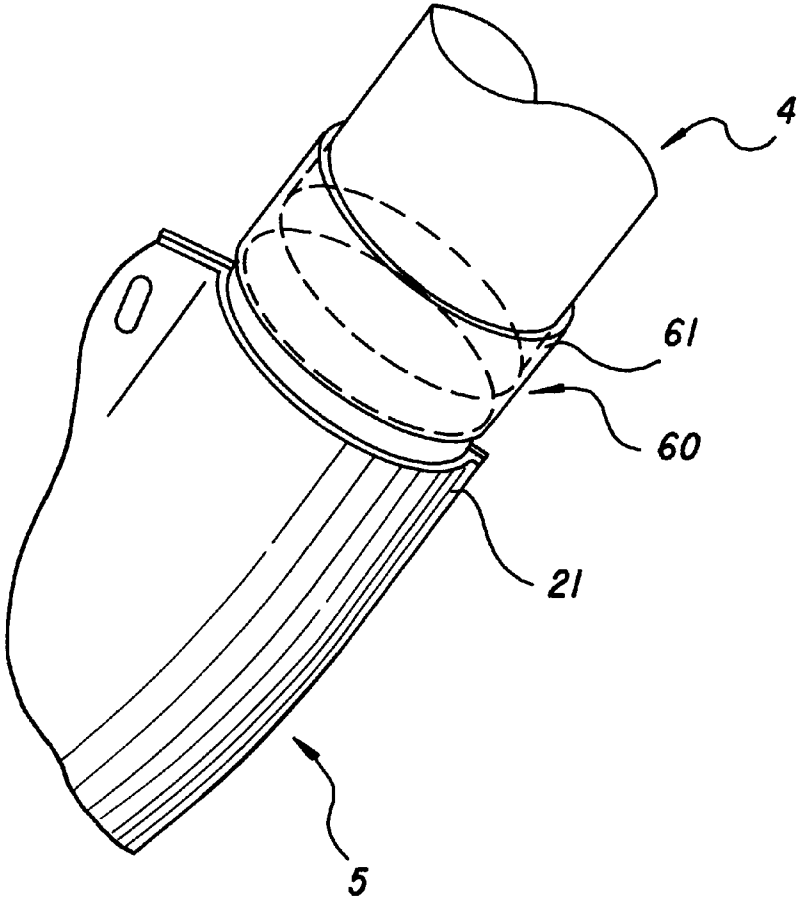
FIG. 21 is a perspective view showing a part thereof.

FIG. 21 is a perspective view showing the above-mentioned construction wherein the guide pipe 60 is fitted and welded to the exhaust manifold chamber 5 and the lower stream end of the manifold pipe 4 is fitted into the upper stream large diameter section 61 of the guide pipe 60 so as to slide. The branched upper stream open end 21 of the manifold chamber 5 is reinforced by the guide pipe 60 fitted and welded thereto.

Figure 22:
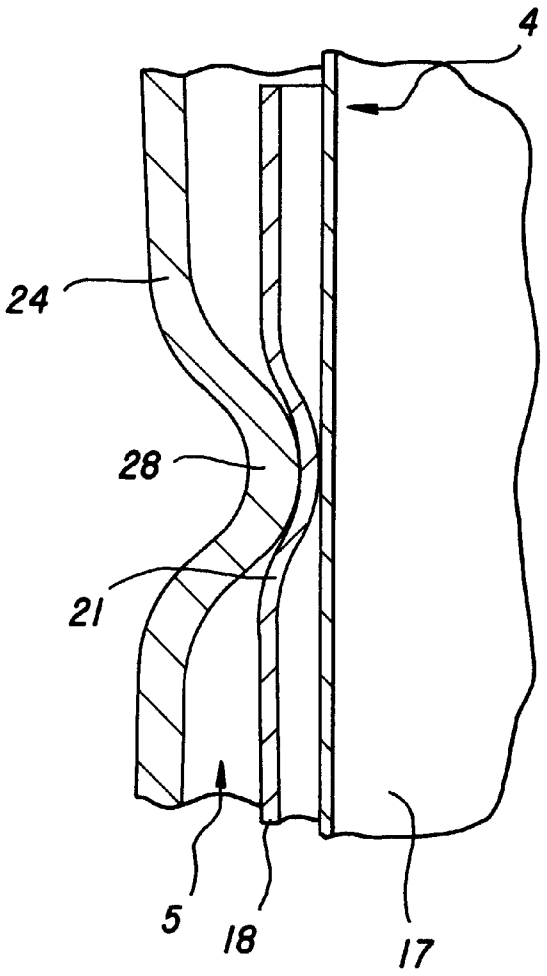
FIG. 22 is a partial sectional view showing an embodiment of the present invention.

FIG. 22 shows further other embodiment of the present invention and is an enlarged sectional view of a portion for connecting the manifold pipe 4 and the manifold chamber 5 in an exhaust manifold which is essentially the same as the aforesaid exhaust manifold 1. The upper stream open end portion 21 of the manifold chamber 5 is bent inward and the lower stream portion 17 of the manifold pipe 4 is fitted to the open end portion 21 so as to slide relatively.

As known from FIG. 22, the wall thickness of the manifold pipe 4 which comes in direct contact with the exhaust of high temperature discharged from the exhaust port directly is thinnest (0.6 mm), the wall thickness of the manifold chamber 5 which comes in direct contact with the exhaust at a lower stream having been somewhat cooled by the manifold pipe 4 is thicker than that of the manifold pipe 4 (0.8 mm), and the wall thickness of the manifold case 6 which covers around the manifold pipe 4 and the manifold chamber 5 and is not contacted with the exhaust is thickest (2 mm). As a result, heat capacities of portions coming in direct contact with the exhaust are small, and further, the exhaust manifold has a good heat insulating nature because of the double construction having a space between the manifold case 6 and the manifold pipe and chamber 4, 5. Therefore, the exhaust is not cooled so much, an exhaust cleaning catalyst in a exhaust pipe can be activated immediately and lowering of initial performance of the exhaust cleaning catalyst can be avoided.

Entire strength and rigidity of the exhaust manifold can be obtained sufficiently by the thick manifold case 6 and lightening of the exhaust manifold can be realized by the thin manifold pipe 4 and manifold chamber 5.

The manifold chamber 5 where the high temperature exhausts concentrate is liable to be heated to the highest temperature. Therefore, the manifold chamber 5 is made thicker than the manifold pipe 4 so as to sufficiently endure the high temperature.

Because the wall thicknesses of the manifold pipe 4, the manifold chamber 5 and the manifold case 6 are set rationally, satisfactory strength and rigidity of the exhaust manifold can be obtained while maintaining heat capacity and weight at a low level.

What is claimed is:

1. An exhaust manifold of a multi-cylinder internal combustion engine including a plurality of thin wall manifold pipes having upper stream ends connected with exhaust ports of the internal combustion engine and lower stream ends gathering in a gathering section made of a plate metal, comprising:

a case of a plate metal fitted around said manifold pipes and said gathering section with a space between;

an upper stream flange to which upper stream ends of said manifold pipes and said case are welded;

a lower stream flange to which lower stream ends of said gathering section and said case are welded; and a slide portion at which said manifold pipe and said gathering section can slide relatively along a longitudinal direction of said manifold pipe, said slide portion being maintained pressed by said gathering section and said case from exterior.

2. An exhaust manifold as claimed in claim 1, wherein said slide portion is maintained by inwardly projecting parts formed on said gathering section and said case respectively.

3. An exhaust manifold as claimed in claim 1, wherein said slide portion is maintained by meshes arranged between said manifold pipe and said gathering section and between said gathering section and said case.

4. An exhaust manifold of a multi-cylinder internal combustion engine including a plurality of thin wall manifold pipes having upper stream ends connected with exhaust ports of the internal combustion engine and lower stream ends gathering in a gathering section made of a plate metal, comprising:

a case fitted around said manifold pipes and said gathering section with a space between;

an upper stream flange to which upper stream ends of said manifold pipes and said case are welded; and a lower stream flange to which a lower stream end of said case is welded, lower stream portions of said manifold pipes being welded to upper stream portions of said gathering section, a lower stream end of said gathering section being held so as to slide relatively to said case.

5. An exhaust manifold as claimed in claim 4, wherein at least one of said manifold pipes has an upper stream end or a lower stream portion held so as to slide.

6. An exhaust manifold of a multi-cylinder internal combustion engine including a plurality of thin wall manifold pipes having upper stream ends connected with exhaust ports of the internal combustion engine and lower stream ends gathering in a gathering section made of a plate metal, comprising:

a case of a plate metal fitted around said manifold pipes and said gathering section with a space between;

an upper stream flange to which upper stream ends of said manifold pipes and said case are welded;

a lower stream flange to which lower stream ends of said gathering section and said case are welded;

a connecting pipe for connecting said manifold pipe and said gathering section with each other, welded to an upper stream open end of said gathering section; and a slide portion provided on said connecting pipe by which said manifold pipe and said gathering section can slide relatively.

7. An exhaust manifold of a multi-cylinder internal combustion engine including a plurality of thin wall manifold pipes having upper stream ends connected with exhaust ports of the internal combustion engine and lower stream ends gathering in a gathering section made of a plate metal, wherein a case of a plate metal is fitted around said manifold pipes and said gathering section with a space between, wall thickness of said manifold pipe is thinner than wall thickness of said gathering section, and wall thickness of said gathering section is thinner than wall thickness of said case.

8. An exhaust manifold as claimed in claim 7, wherein a slide portion at which said manifold pipe and said gathering section can slide relatively is provided, and said slide portion is maintained by inwardly projecting parts formed on said gathering section and said case respectively.

* * * * *